US005205083A

United States Patent [19]

Pettibone

[11] Patent Number: 5,205,083

[45] Date of Patent: Apr. 27, 1993

[54] METHOD AND APPARATUS FOR POLISHING OPTICAL LENSES

[76] Inventor: Dennis R. Pettibone, 142 Marian Ave., Elmira Heights, N.Y. 14903

[21] Appl. No.: 782,369

[22] Filed: Oct. 24, 1991

[51] Int. Cl.[5] ..... B24B 1/00; B24B 13/02; B24B 29/00

[52] U.S. Cl. ..... 51/284 R; 51/325; 51/328; 51/373; 51/131.4; 51/129

[58] Field of Search ..... 51/109 R, 129, 131.1, 51/131.3, 131.4, 105 LG, 124 L, 134.5 R, 134.5 F, 284 R, 317, 325, 328, 349, 372-373

[56] References Cited

U.S. PATENT DOCUMENTS

| | | | |
|---|---|---|---|
| 2,023,811 | 12/1935 | Houchin . | |
| 3,050,909 | 8/1962 | Rawstron . | |
| 3,430,391 | 3/1969 | Borish . | |
| 3,471,976 | 10/1969 | Barnett . | |
| 3,490,183 | 1/1970 | Briggs | 51/373 X |
| 3,499,250 | 3/1970 | Jensen et al. | 51/109 R |
| 4,373,991 | 2/1983 | Banks . | |
| 4,458,454 | 7/1984 | Barrett . | |
| 4,598,502 | 7/1986 | Lombard | 51/284 R |
| 4,789,424 | 12/1988 | Fornadel et al. | 51/284 R X |

*Primary Examiner*—Bruce M. Kisliuk
*Assistant Examiner*—John A. Marlott
*Attorney, Agent, or Firm*—Barnard & Brown

[57] ABSTRACT

A new and improved method and apparatus for polishing optical lenses using free-flowing polishing fluid (23) passing across a flexible permeable membrane (1). The free-flowing polishing fluid (23) forces the permeable membrane (5) to conform to the shapes and curves of an optical lens (2), polishing and cooling the lens (2) at the same time. In addition, the free-flowing polishing fluid (23) continually replenishes the polishing compound of the polishing fluid (23) during the polishing process.

10 Claims, 4 Drawing Sheets

METHOD AND APPARATUS FOR POLISHING OPTICAL LENSES

BACKGROUND OF THE INVENTION

1. Field of Invention

This invention relates to polishing optical lens. Specifically, this invention concerns a new and improved apparatus for and method of polishing the surfaces of optical lens, using free-flowing polishing fluid pumped across and pressurizing a permeable membrane to conforms to the shape of the lens being polished.

2. Background Information

Prior art teaches several methods of and apparatuses for polishing optical lenses, however, these methods and apparatuses do not overcome many of the problems with lens polishing today. In fact, lens polishing methods have lagged far behind the rapid advances in lens cutting methods (e.g. programmable lathes). Today, much polishing work for custom lenses, which may have very complex curves, is still done by hand with lapping tools, in a very labor intensive manner. Some other problems in lens polishing are: a. the heat generated during polishing may warp or deform the shape of the lens, b. having to replenish the polishing compound during the polishing process, c. the cost of training personnel in polishing is both expensive and time consuming, d. lapping tools may grind the lens as well as polish them, and e. conforming the polishing surface to all shapes and curves of optical lenses.

Barnett (U.S. Pat. No. 3,471,976, "Process for Making Multi-focal Contact Lens") uses a chamois or other flexible material stretched across a bowl to selectively grind parts of the lens. Borish (U.S. Pat. No. 3,430,391, "Apparatus for and Method of Altering the Power of a Corneal Contact Lens") utilizes a resilient and deformable member having a polishing surface, with polishing compound on polishing surface, to alter the power of the lens. Barnett's patent and Borish's patent, however, are drawn to methods of grinding lenses, and not polishing. Both emphasize their methods as enabling one to change the shape of the lens in a desired manner. In addition, Barnett and Borish do not cool the lens during polishing, do not continuously replenish the polishing surface with polish, and do not teach the use of free-flowing polishing liquid across a permeable membrane.

Bank's patent (U.S. Pat. No. 4,373,991, "Methods and Apparatus for Polishing a Semiconductor Wafer") is directed at polishing—a method a polishing semiconductor wafers. Bank's invention pertains to the polishing of flat surfaces, such as silicon wafers. The polishing surface (pad) like the silicon wafer is flat and not conformable to a multitude of shapes. Furthermore, Bank's invention does not teach the use of free-flowing fluid pressurizing the polishing surface. The fluid of Bank's invention, instead, is used to create a "bearing" between the wafer and its holder, allowing the wafer to rotate while it is being polished. The fluid does not polish the wafer or replenish the polishing compound.

Rawston's patent (U.S. Pat. No. 3,050,909, "Apparatus for and Method of Polishing Aspheric Surfaces") and Barnett's patent (U.S. Pat. No. 4,458,454, "Methods of Shaping Contact Lens") teach the use of a sealed compartment, filled with air or liquid and covered by a flexible sheet of some sort, against which a lens is placed for polishing. In both cases the polishing compound is applied to the polishing side thereof, and is supported by fluid pressure from the other side. The potential problems, however, remain: a: the heat generated during polishing may alter the power of the lens, and b. having to reapply polishing compound during the polishing process. An additional concern to those schooled in the art may be the even application of the polish, which is not a concern in the applicant's invention.

Barnett's patent (U.S. Pat. No. 4,458,454) discusses the possibility of fluid compartment not being "fluid-tight", but rather that the fluid which "leaks" out could be replaced. This does not suggest, however, a free-flowing polish, nor a flowing fluid cooling the lens and replenishing the polish. Barnett (U.S. Pat. No. 4,458,454) does not suggest his flexible sheet should be intentionally permeable, only that it would not be a problem should some liquid accidentally leak out.

Houchin (U.S. Pat. No. 2,023,811) discloses a method of replenishing the polishing compound used in polishing, where the polishing compound is in fluid form and is applied onto a lap by a pan-like polish receiving and applying means. The polishing fluid, however, does not cross a conformable permeable membrane, does not pressurize the polishing surface (e.g. flexible permeable membrane) to conform to the shape and curves of the lens being polished, and is not applied directly and uniformly on the lens.

There is a need, therefore, for a method of and apparatus for polishing lens that overcomes the great variety of problems faced by lens polishers. Up to the point of this invention no polishing process has been established for polishing optical lens using free-flowing polishing fluid, pumped across a flexible, conformable permeable membrane, thereby: a. continuously replenishing the polishing compound, b. cooling the lens, thus, avoiding warping the lens during the polishing process, c. applying uniform pressure on the lens, d. conforming said flexible permeable membrane to all shapes (e.g. concave) and curves of lenses, e. polishing quickly and efficiently, and f. applying polish uniformly on the lens. Such a process, also, had not been suggested or taught in the prior art.

SUMMARY

A new and improved method and apparatus for polishing optical lens has been established. This is the first method of polishing optical lenses utilizing a free-flowing polishing fluid flowing across (the word "across", as used herein, means going from one side of the membrane, through the membrane, to the other side of the membrane) and pressurizing a conformable flexible permeable membrane to the shape of a lens to better polish the lens. The free-flowing polishing fluid, comprising polishing compound(s) suspended in a liquid medium, flows across a permeable membrane, pressurizing the membrane, forcing the membrane to adopt the shape of the lens being polished, and then polishes the lens. The disclosed invention improves on previous art, by performing all of the following with a simple apparatus: a. continuously replenishing the polishing compound, b. cooling the lens, thus avoiding warping the lens during the polishing process, c. applying uniform pressure on the lens, d. conforming the flexible permeable membrane to all shapes (e.g. concave) and curves of lenses, e. polishing quickly and efficiently, and f. applying polish uniformly on the lens.

It is therefore an object of this invention to disclose a novel method of polishing optical lenses.

It is another object of this invention to disclose a method of polishing optical lenses utilizing free-flowing polishing fluid.

It is yet another object of this invention to disclose a method of polishing optical lenses which cools the lens during polishing.

It is yet another object of this invention to disclose a method of polishing optical lenses which continually replenishes the polishing compound.

It is yet another object of this invention to disclose a novel apparatus for polishing optical lenses.

It is yet another object of this invention to disclose an apparatus for polishing optical lenses which includes a permeable flexible membrane—allowing free-flowing polishing fluid to contact said lens and which conforms to all shapes and curves of said lens.

Further objects of the invention will be set forth in the description which follows, and will become apparent to those skilled in the art upon examination of the specification or by practice of the invention.

DETAILED DESCRIPTION OF THE INVENTION

Figure 1:
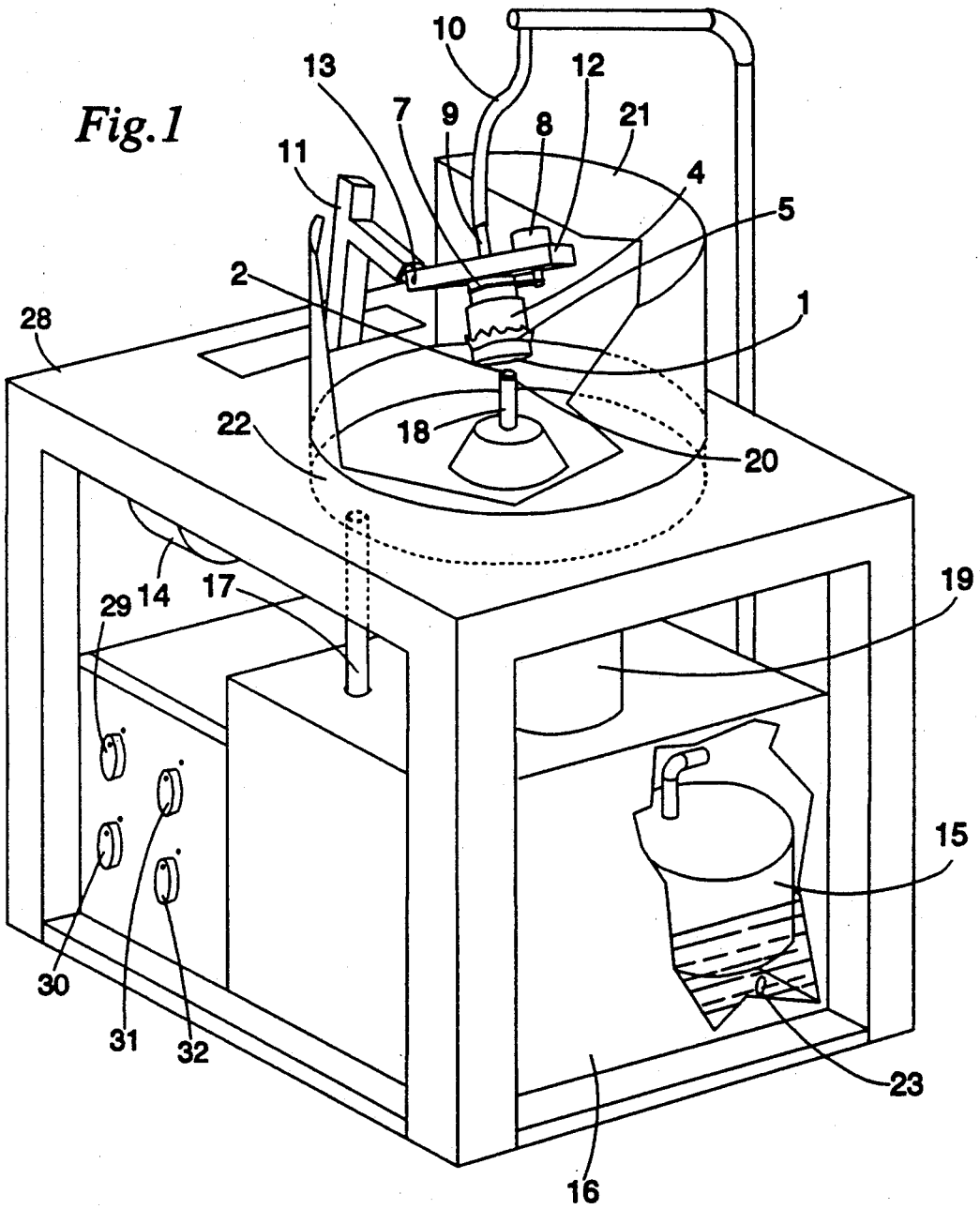
FIG. 1 is a front/right side elevation view of the polishing apparatus.

The polishing apparatus of this invention comprises several parts: a. a flexible permeable membrane (1) (permeable membrane may be comprised of cloths, such as silk, cotton, velveteen, etc. . . ) (see FIGS. 2 and 3) conforming to the shape and curves of a lens (2) being polished and allowing the flow of polishing fluid (3) to said lens, b. a polishing cup (4), connected to said permeable membrane by an elastic belt (5) or otherwise similar material, seated on a set of bearings (6) (see FIG. 3) and rotated by an elastic belt (7) (see FIGS. 1 and 2) or otherwise similar material, turned by small variable speed motor (8), c. a connecting tube (9) connected to said bearings (6) of the polishing cup on one end and to the polish hose (10) on the other end, d. a motor driven radial oscillation arm (11) with an adjoining arm (12), pivotally attached to said radial oscillation arm by a pivot nut (13) and also attached to (8) and (9), positions the polishing cup and membrane over the lens (2), and with said adjoining arm and said adjoining arm's attached parts, is rocked (radially oscillated) by attached variable speed radial oscillation arm motor (14), e. a metering pump (15) (see FIG. 1) which controls the flow of polish, and draws the polish from a sump (16) (holding-tank) in which the polish also returns to through a drain pipe (17), f. a lens supporting device (18), spun by a lens supporting device variable speed motor (19), holding said lens in place, with the aid of dental impression wax (20), g. a splash shield (21) mounted on a polishing bowl (22), fitting into and supported by a support table (28), surrounding the lens supporting device and funneling into the drain pipe (17), and h. the speed of all variable speed motors: a. the radial oscillation arm variable speed motor (14), b. the polishing cup variable speed motor (8), c. the lens supporting device variable speed motor (19), and d. the metering pump (15) are controlled respectively by reostats (29), (30), (31), and (32).

Figure 2:
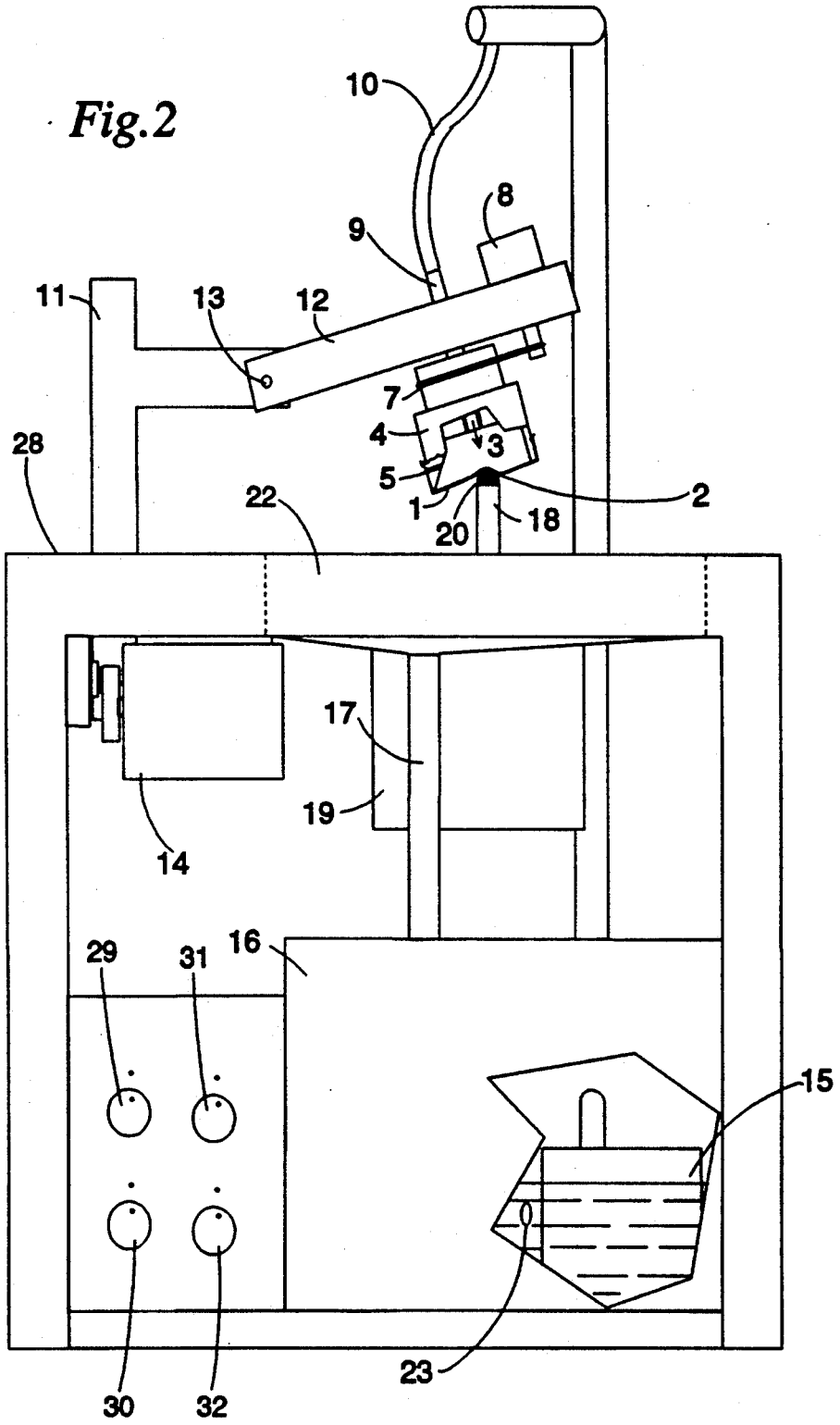
FIG. 2 is right side view of the polishing apparatus, showing free-flowing polishing liquid flow, and the flexible permeable membrane conforming to the shape of a lens.
Figure 3:
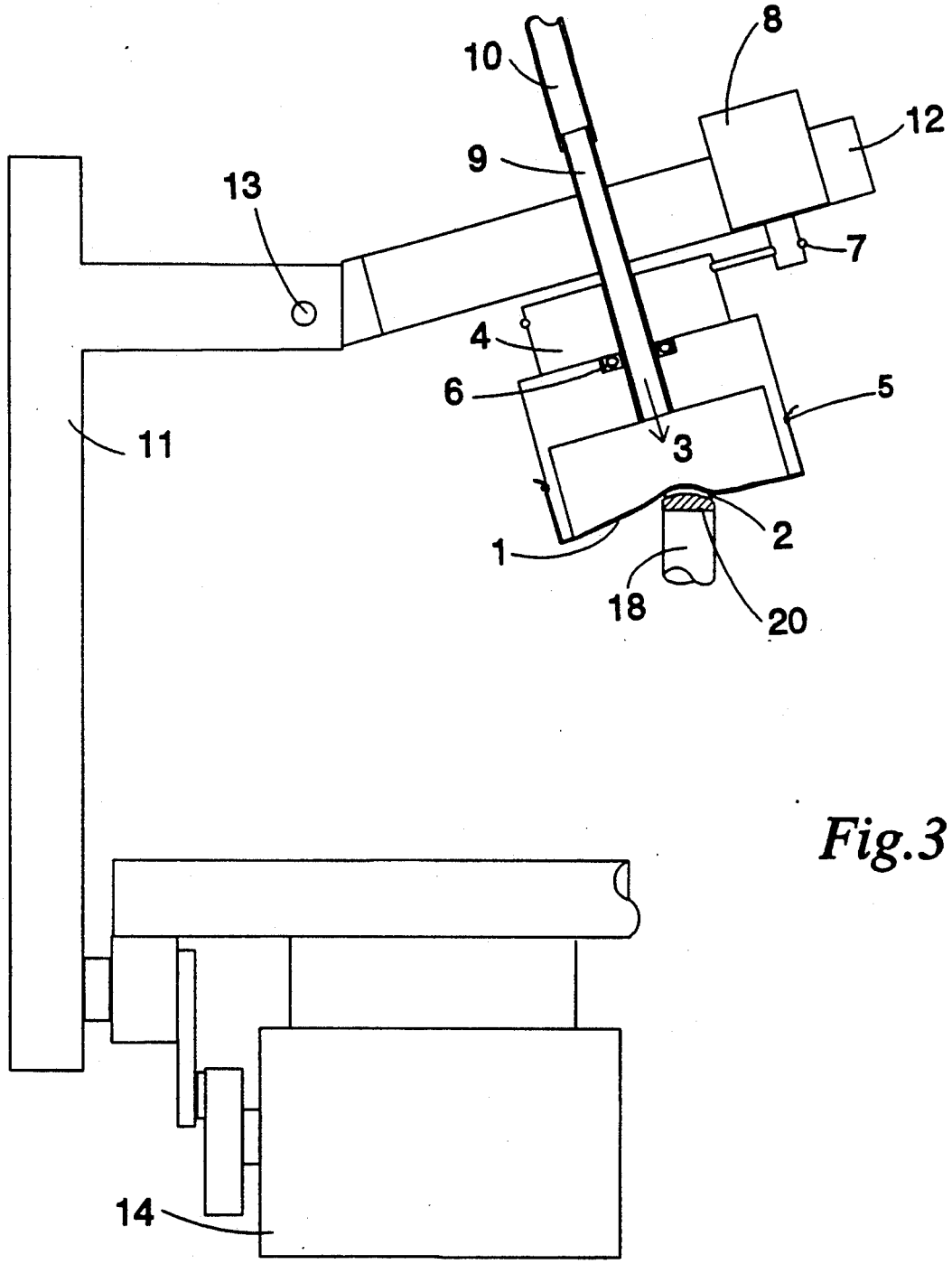
FIG. 3 is a close-up right side cut-away view of the polishing cup, bearings, permeable membrane, and connecting tube.

Thus, the preferred embodiment for a polishing apparatus using free-flowing polishing fluid pumped across a flexible permeable membrane (1) (see FIG. 2, pressurizing said permeable membrane (1) to adopt the shape of a lens (2), applying uniform pressure on said lens (2), and polishing and cooling said lens (2), comprises the parts of: a. a polishing sump (16) (see FIG. 1), b. a polishing tube (10), c. a polishing cup variable speed motor (8), d. an elastic belt for said polishing cup variable speed motor (7), e. a polishing cup (4), f. a flexible permeable membrane, g. a supporting table (28), h. an elastic belt for said permeable membrane (5), i. a metering pump (15), j. a motor driven radial oscillation arm (11) with an adjoining arm (12), k. a pivot nut (13), 1. a radial oscillation arm variable speed motor (14), m. bearings (6) (see FIG. 3), n. a connecting tube (9) (see FIG. 1), o. a polishing hose (10), p. a lens supporting device (18), q. a lens supporting device variable speed motor (19), r. a splash shield (21), s. a polishing bowl (22), t. a drain pipe (17), and u. reostats (29, 30, 31, and 32), wherein, the permeable membrane (1) is connected to said polishing cup (4) by said elastic belt for said permeable membrane (5) or otherwise similar device, said polishing cup (4) is seated on said set of bearings (6) (see FIG. 3), and is rotated by said elastic belt for said polishing cup variable speed motor (7) (see FIG. 1) or otherwise similar device, turned by said polishing cup variable speed motor (8); one end of said connecting tube (9) connects to said bearings (6), attached to said polishing cup (4), and the other end of said connecting tube (9) connects to said polishing hose (10); said motor driven radial oscillation arm (11) with said adjoining arm (12), attached to said radial oscillation arm (11) by said pivot nut (13) on one end of said adjoining arm (12), and attached to said connecting tube (9) and said polishing cup variable speed motor (8) on the other end of said adjoining arm (12), directs said polishing cup (4) and said flexible permeable membrane (1) over the surface of said lens (1), said lens (1) held steady by said supporting device (18) with the aid of said dental impression wax (20); said lens supporting device (18) is spun (in the counter direction to or in the same direction as the spinning polishing cup) by said lens supporting device variable speed motor (19); said metering pump (15) controls the flow of polish (3), drawing said free-flowing fluid (23) from said polishing sump (16); said polishing bowl (22), fitting into and supported by said supporting table (28), surrounds said lens supporting device (18), collects the polishing fluid, funneling said fluid to said drain pipe (17), connected to said polishing sump (16); a splash shield (21) mounted on said polishing bowl (22), and returning said polishing fluid into said polishing bowl (22); said reostats (29, 30, 31, and 32) controls said radial oscillation arm variable speed motor (14), said polishing cup variable speed motor (8), said lens supporting device variable speed motor (19), and said metering pump (15), respectively.

The above described apparatus is the preferred embodiment of the invention; however, the preferred embodiment does not serve as a restriction requirement applied specifically to the invention which may be realized in other forms or devices. For example, a rotating hand held polishing device utilizing the free-flowing polishing fluid, passing across a conformable permeable membrane, easily held at any angle, and applied on a variety of surfaces, of widely varying sizes and compositions, is not beyond the scope of this invention.

Figure 4:
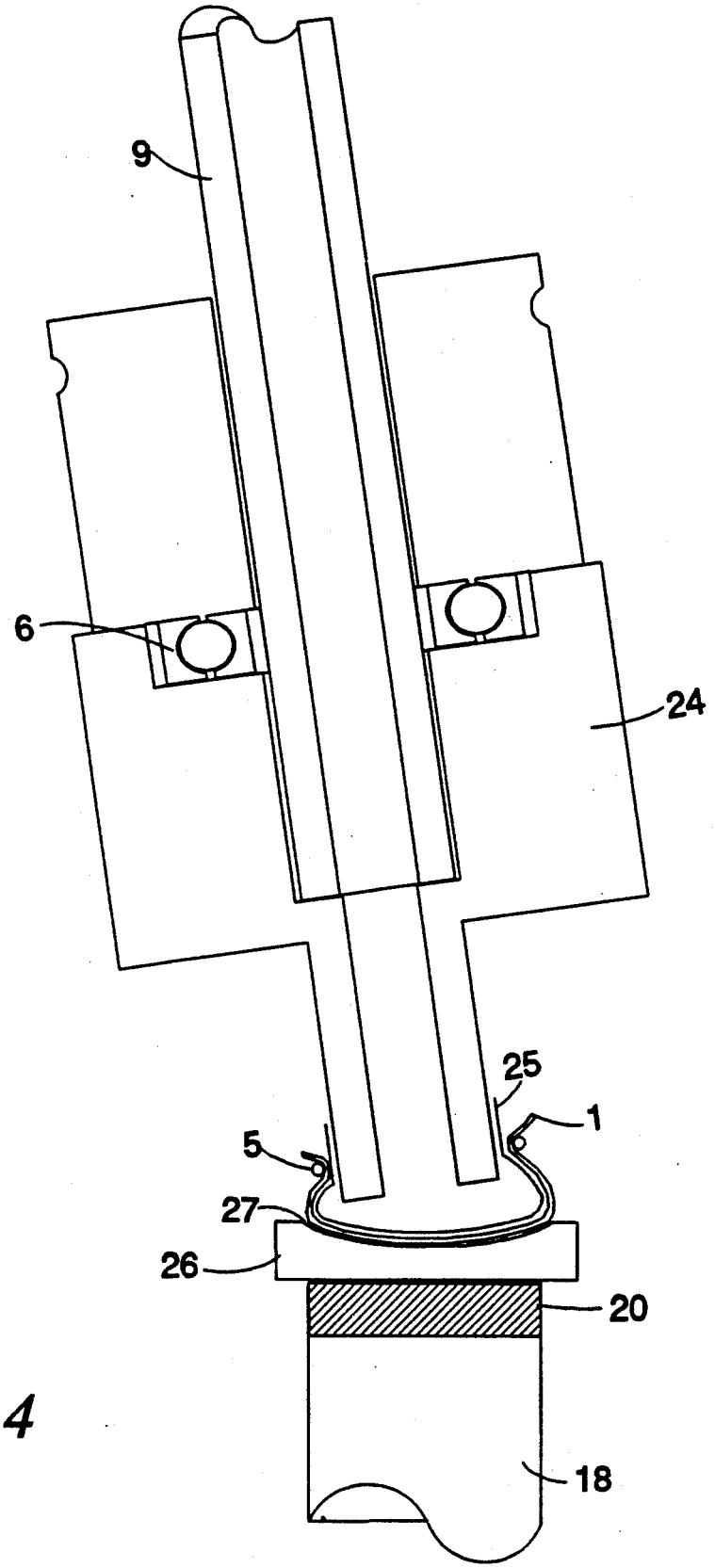
FIG. 4 is a close-up right side cut-away view of a smaller polishing cup and permeable membrane, adapted to polish the concave side of small lenses.

The polishing apparatus may also be increased in size for polishing larger surfaces or decreased in size for surface smaller than contacts. In particular, the size of the polishing cup (4) (see FIG. 1) and permeable membrane (1) may be easily altered to the specifications of the lens (2) being polished. A smaller polishing cup (24) (see FIG. 4) with á permeable membrane (1) may be preferred for polishing the concave side (27) (the back) of small lenses, still in the form of a lens block (26). In this case, a smaller polishing cup (4) and permeable membrane (1) are utilized, and an elastic balloon-like porous member (25) is first attached to the polishing cup, and then the flexible permeable membrane is attached to the polishing cup (24), over the elastic balloon-like porous material (25), both attached to the polishing cup (24) by one elastic belt (5). Such a device and arrangement supports and maintains the permeable membrane's conformation to the shape of the lens.

The polishing process using free-flowing polishing fluid pumped across a flexible permeable membrane (1)(see FIG. 2), pressurizing said permeable membrane (1) to adopt the shape of the lens (2), applying uniform pressure on said lens (2), and polishing and cooling said lens (2), comprises the steps of: a. pumping out polishing fluid (23) stored in the polishing sump (16) using a metering pump (15), b. controlling the force with which the polishing fluid (23) flows, with the metering pump (15), c. filling the flexible permeable membrane (1), with the free-flowing polishing fluid (23), d. conforming the flexible permeable membrane (1) to the shape of the lens (4), by the pressure of the free-flowing polishing fluid (23), e. applying uniform pressure, on the lens (2), by the flow of the free-flowing polishing fluid (3) across the permeable membrane (1), f. contacting said lens (2) with the free-flowing polishing fluid (23), g. polishing the lens (2) by the action of polishing compound in the free-flowing polishing fluid (23), h. cooling the lens (2) by the action of the free-flowing polishing fluid (23), j. rotating the flexible permeable membrane (1) atop the lens (2) by the action of the polishing cup variable speed motor (8), k. rotating lens supporting device (18) in the counter direction to the rotating polishing cup (4), by the action of the lens supporting device variable speed motor (19), and 1. rocking the permeable membrane (1), by the action of a radial oscillation arm (11).

The free-flowing polishing fluid differs for "hard" and "soft" lenses. The free-flowing polishing fluid which flows across porous membranes polishing, and cooling optical lenses, as well as continually replenishing the polishing fluid is comprised of: a. a polishing compound, and b. a liquid medium, wherein the said polishing compound is suspended in said liquid medium. In the case of soft lenses the liquid medium is an oil, while the liquid medium for hard lenses is usually water. A preferred water-based polishing fluid for "hard" lenses is Clesco Ultrasheen polish. Other water-based polishes which may be used to polish the lens are: a. X-PAL, b. Sil-$O_2$-Care, c. Aluminum Oxide, and d. mixtures of the above-identified water-based polishes.

The flexible permeable membrane (1) (see FIG. 2) which allows the flow of polishing compound (3) to the lens (2) may be comprised of silk, cotton, velveteen or any other natural or synthetic porous material(s). The permeable membrane (1) conforms to all curves of optical lens. It can conform to spherical, multi-spherical, aspheric, elliptical, parabolic, hyperbolic, and any combination of shapes or forms, without altering or distorting the surface of said optical lens.

The pore size of a permeable membrane employed will vary according to the polishing fluid used, the pressure of the free-flowing polish, and the size of the lens being polished. The rotational speed of the polishing cup and the lens supporting device may vary as well. Furthermore, the axis of rotation of the polishing cup may be adjustable (by modifying the location said pivot nut (13)) and the axis of rotation of the lens supporting device need not be collinear. In fact, the axis of rotation of the polishing cup (4) (see FIG. 1) in the preferred embodiment forms approximately a 60° angle with the axis of rotation of the lens supporting device (18) in the preferred embodiment of the invention. The rocking motion, provided by the radial oscillation arm (11), may further improve the uniformity of this polishing process (Rawston).

Thus, this invention is a new and improved apparatus and process using free-flowing polishing fluid, pumped across a permeable membrane (1) (see FIG. 2), polishing and cooling optical lenses (2), continually replenishing the polishing compound, and conformable to all shapes and curves of lenses.

The foregoing description has been directed to particular embodiments of the invention in accordance with the requirements of the Patent Statutes for the purposes of illustration and explanation. It will become apparent, however, to those skilled in the art that many modifications and changes will be possible without departure from the scope and spirit of the invention. It is intended that the following claims be interpreted to embrace all such modifications.

What is claimed is:

1. A method of polishing a lens using free-flowing polishing fluid pumped across a flexible permeable membrane, wherein the lens is mounted on a rotatable lens supporting device, comprising the steps of:

a) pressurizing the flexible permeable membrane with a free-flowing polishing fluid, whereby the free-flowing polishing fluid is caused to flow across the flexible permeable membrane, b) pressing the flexible permeable membrane against the lens, whereby the pressure of the free-flowing polishing fluid across the permeable membrane exerts a uniform pressure on the lens and causes the flexible permeable membrane to adopt the shape of the lens, c) rotating the flexible permeable membrane atop the lens, and d) rotating the lens supporting device is the counter direction to or the same direction as the rotating flexible permeable membrane, whereby the lens is polished by the action of the flexible permeable membrane, and is cooled by the flow of the free-flowing polishing fluid.

2. The method of claim 1, further comprising, the following steps:

prior to step (a) of the method:

a) pumping out free-flowing polishing fluid stored in a polishing sump using a metering pump, b) controlling the force with which the polishing fluid flows with the metering pump, c) filling the flexible permeable membrane with the free-flowing polishing fluid, and prior to step (d) of the method:

d) rocking the flexible permeable membrane by the action of a radial oscillation arm.

3. The method of claim 1, wherein the axis of rotation of the permeable membrane and the axis of rotation of the lens supporting device are not collinear.

4. The method of claim 1, wherein the free-flowing polishing fluid flowing across said lens is continually replenished by the flow of free-flowing polishing fluid pressurizing said flexible permeable membrane.

5. The method of claim 1, in which the flexible permeable membrane is made of a natural cloth.

6. The method of claim 5, in which the natural cloth is silk.

7. The method of claim 5, in which the natural cloth is cotton.

8. The method of claim 1, in which the free-flowing polishing fluid comprises a polishing compound suspended in a liquid medium.

9. The method of claim 8, in which the liquid medium is an oil, when polishing "soft" lenses.

10. The method of claim 8, in which the liquid medium is water, when polishing "hard" lenses.

* * * * *